US009061797B2

(12) United States Patent
Goldburt

(10) Patent No.: US 9,061,797 B2
(45) Date of Patent: Jun. 23, 2015

(54) BOTTLE FOR ALCOHOLIC OR NON ALCOHOLIC BEVERAGES

(75) Inventor: Tim Goldburt, Ardsley, NY (US)

(73) Assignee: Medea Inc., Pleasanton, CA (US)

( * ) Notice: Subject to any disclaimer, the term of this patent is extended or adjusted under 35 U.S.C. 154(b) by 1828 days.

(21) Appl. No.: 11/588,494

(22) Filed: Oct. 28, 2006

(65) Prior Publication Data

US 2008/0100469 A1 May 1, 2008

(51) Int. Cl.
*B65D 83/04* (2006.01)
*B65D 23/14* (2006.01)

(52) U.S. Cl.
CPC ..... *B65D 23/14* (2013.01); *B65D 2203/12* (2013.01)

(58) Field of Classification Search
CPC ..... B65D 1/04; B65D 51/28; B65D 23/12; A61J 9/00; A47G 19/2205
USPC ..... 446/73, 297, 267, 304, 76; 215/6, 396; 206/217, 213.1, 534; 220/23.83, 503; 362/101, 154, 276, 34
See application file for complete search history.

(56) References Cited

U.S. PATENT DOCUMENTS

| | | | | |
|---|---|---|---|---|
| 97,669 | A | | 12/1869 | Millen |
| D20,656 | S | | 3/1891 | Dawes |
| D23,100 | S | | 3/1894 | Fay et al. |
| 716,793 | A | | 12/1902 | Vogeler |
| 823,008 | A | | 6/1906 | Vendig |
| 1,262,788 | A | | 4/1918 | Heidenreich |
| 1,554,191 | A | | 9/1925 | Alexander |
| 1,653,608 | A | | 3/1927 | Allen |
| 1,686,354 | A | | 3/1927 | Wallace |
| 1,769,147 | A | | 12/1927 | Benjamin |
| 1,856,550 | A | | 12/1928 | Guenard |
| 1,770,093 | A | | 2/1929 | West |
| D79,958 | S | | 11/1929 | De Wagner |
| D85,487 | S | | 7/1931 | Meyer |
| 3,864,976 | A | | 2/1975 | Parker |
| 3,965,590 | A | | 6/1976 | Algaze |
| 3,996,879 | A | | 12/1976 | Walton |
| 4,607,756 | A | | 8/1986 | Courtman |
| D285,903 | S | | 9/1986 | Courtman |
| 4,765,465 | A | * | 8/1988 | Yamada et al. ..... 206/217 |
| 4,928,412 | A | | 5/1990 | Nishiyama |
| D314,308 | S | * | 2/1991 | Cogswell ..... D7/507 |
| D317,123 | S | | 5/1991 | Colani |

(Continued)

FOREIGN PATENT DOCUMENTS

| | | |
|---|---|---|
| JP | 07-027624 | 1/1995 |
| WO | WO 03/099039 | 12/2003 |
| WO | WO 2010/138107 | 12/2010 |

OTHER PUBLICATIONS

Tech-Recipes, http://www.tech-recipes.com/rx/2484/iphone_change_the_auto_lock_delay/, Jun. 29, 2007.

(Continued)

*Primary Examiner* — Fenn Mathew
*Assistant Examiner* — Cynthia Collado
(74) *Attorney, Agent, or Firm* — Lowenstein Sandler LLP

(57) ABSTRACT

A bottle for alcoholic or non alcoholic beverages has a hollow body part defining an inner space for filling an alcoholic or non alcoholic beverage, and at least one device selected from the group consisting of an electrical device and electronic device and integrated in said hollow body part without interfering with a content of the bottle.

12 Claims, 6 Drawing Sheets

(56) References Cited

U.S. PATENT DOCUMENTS

| | | | | | |
|---|---|---|---|---|---|
| D318,224 | S | | 7/1991 | Altobelli | |
| 5,125,866 | A | * | 6/1992 | Arad et al. | 446/397 |
| 5,168,646 | A | | 12/1992 | Dippong et al. | |
| 5,201,431 | A | * | 4/1993 | Berger et al. | 215/386 |
| 5,211,699 | A | | 5/1993 | Tipton | |
| 5,297,247 | A | | 3/1994 | Kan | |
| 5,339,548 | A | * | 8/1994 | Russell | 40/324 |
| 5,379,916 | A | | 1/1995 | Martindale et al. | |
| 5,553,735 | A | | 9/1996 | Kimura | |
| 5,575,553 | A | | 11/1996 | Tipton | |
| 5,678,925 | A | | 10/1997 | Garmaise et al. | |
| 5,823,346 | A | * | 10/1998 | Weiner | 206/534 |
| 5,863,752 | A | | 1/1999 | Court et al. | |
| 5,884,421 | A | | 3/1999 | Key | |
| 5,992,678 | A | | 11/1999 | Willey | |
| 6,037,872 | A | * | 3/2000 | Dunnum | 340/586 |
| 6,062,380 | A | * | 5/2000 | Dorney | 206/217 |
| 6,158,870 | A | * | 12/2000 | Ramirez | 362/101 |
| D436,852 | S | | 1/2001 | Chan | |
| 6,213,616 | B1 | * | 4/2001 | Chien | 362/84 |
| 6,302,608 | B1 | | 10/2001 | Holmes et al. | |
| 6,393,401 | B1 | | 5/2002 | Loudermilk et al. | |
| D470,770 | S | | 2/2003 | Machado et al. | |
| 6,527,402 | B1 | * | 3/2003 | Borri | 362/86 |
| D473,469 | S | | 4/2003 | Claessen | |
| 6,588,131 | B2 | | 7/2003 | O'Connell, Jr. | |
| 6,588,593 | B2 | | 7/2003 | Woskoski | |
| 6,747,918 | B2 | | 6/2004 | Hight et al. | |
| 6,762,734 | B2 | | 7/2004 | Blotky et al. | |
| 6,872,116 | B1 | * | 3/2005 | Dunnum et al. | 446/73 |
| 6,923,549 | B2 | | 8/2005 | Hoy | |
| 6,945,418 | B2 | | 9/2005 | Guido et al. | |
| 7,000,343 | B1 | | 2/2006 | Teichman | |
| D521,388 | S | | 5/2006 | Andoh | |
| D521,389 | S | | 5/2006 | Andoh | |
| D522,865 | S | | 6/2006 | Andoh | |
| D523,346 | S | | 6/2006 | Andoh | |
| 7,152,832 | B2 | | 12/2006 | Wochnick | |
| 7,163,311 | B2 | | 1/2007 | Kramer | |
| 7,300,171 | B2 | * | 11/2007 | Sutton | 362/101 |
| D571,153 | S | * | 6/2008 | Lopez | D7/511 |
| 7,383,650 | B2 | | 6/2008 | Duesler | |
| D574,249 | S | | 8/2008 | Seum et al. | |
| D575,583 | S | * | 8/2008 | Morgan | D7/510 |
| 7,413,082 | B2 | | 8/2008 | Adler et al. | |
| D596,037 | S | | 7/2009 | Slubski | |
| 7,690,533 | B2 | | 4/2010 | Stilley | |
| D617,200 | S | | 6/2010 | Goldburt | |
| 7,824,051 | B2 | | 11/2010 | Walter et al. | |
| 7,837,333 | B2 | | 11/2010 | Chou et al. | |
| 7,934,845 | B2 | | 5/2011 | Yang | |
| 7,954,970 | B2 | | 6/2011 | Goldburt | |
| 8,056,273 | B2 | | 11/2011 | Goldburt | |
| 8,123,033 | B2 | | 2/2012 | Goldburt | |
| 2002/0097195 | A1 | | 7/2002 | Frank | |
| 2002/0104848 | A1 | | 8/2002 | Burrows et al. | |
| 2002/0126150 | A1 | | 9/2002 | Parry | |
| 2002/0190869 | A1 | | 12/2002 | Blotky et al. | |
| 2003/0099158 | A1 | | 5/2003 | De la Huerga | |
| 2003/0129283 | A1 | | 7/2003 | Martinez Carballido | |
| 2003/0226298 | A1 | | 12/2003 | Bjork | |
| 2004/0004829 | A1 | * | 1/2004 | Policappelli | 362/101 |
| 2004/0026357 | A1 | | 2/2004 | Beck et al. | |
| 2004/0118022 | A1 | | 6/2004 | Duesler | |
| 2004/0140286 | A1 | * | 7/2004 | Zoller | 215/379 |
| 2004/0148117 | A1 | | 7/2004 | Kirshenbaum et al. | |
| 2004/0206828 | A1 | | 10/2004 | Harris | |
| 2005/0024858 | A1 | | 2/2005 | Johnson | |
| 2005/0036301 | A1 | | 2/2005 | Haines | |
| 2005/0134461 | A1 | | 6/2005 | Gelbman et al. | |
| 2005/0193612 | A1 | | 9/2005 | Lowry | |
| 2005/0205437 | A1 | | 9/2005 | Huffman | |
| 2005/0207141 | A1 | | 9/2005 | Boesch et al. | |
| 2005/0229449 | A1 | | 10/2005 | Shepley | |
| 2005/0270396 | A1 | | 12/2005 | Miyashita et al. | |
| 2006/0087831 | A1 | | 4/2006 | Kramer | |
| 2006/0118507 | A1 | | 6/2006 | Feldman | |
| 2006/0139928 | A1 | * | 6/2006 | Griffiths et al. | 362/276 |
| 2006/0202042 | A1 | | 9/2006 | Chu | |
| 2006/0231109 | A1 | | 10/2006 | Howell et al. | |
| 2007/0024465 | A1 | * | 2/2007 | Howell et al. | 340/870.01 |
| 2007/0069883 | A1 | | 3/2007 | Collier et al. | |
| 2007/0091123 | A1 | | 4/2007 | Akashi | |
| 2007/0158293 | A1 | | 7/2007 | Andreani | |
| 2008/0023357 | A1 | | 1/2008 | Whiteis | |
| 2008/0034628 | A1 | | 2/2008 | Schnuckle | |
| 2008/0074625 | A1 | | 3/2008 | Lai et al. | |
| 2008/0128300 | A1 | | 6/2008 | Bahar et al. | |
| 2008/0149589 | A1 | | 6/2008 | Lach | |
| 2008/0264816 | A1 | | 10/2008 | Yeh | |
| 2008/0296191 | A1 | | 12/2008 | Ransch | |
| 2008/0314861 | A1 | | 12/2008 | Goldburt | |
| 2008/0317906 | A1 | | 12/2008 | Goldburt | |
| 2009/0293328 | A1 | | 12/2009 | Bull | |
| 2010/0101124 | A1 | | 4/2010 | Sorensen | |
| 2010/0182518 | A1 | | 7/2010 | Kirmse et al. | |
| 2010/0300913 | A1 | | 12/2010 | Goldburt | |
| 2010/0300914 | A1 | | 12/2010 | Goldburt et al. | |
| 2011/0100852 | A1 | | 5/2011 | Goldburt | |
| 2011/0100853 | A1 | | 5/2011 | Goldburt | |
| 2011/0122120 | A1 | | 5/2011 | Feuilloley | |
| 2011/0155604 | A1 | | 6/2011 | Goldburt | |
| 2011/0303579 | A1 | | 12/2011 | Sanders | |
| 2012/0171963 | A1 | | 7/2012 | Tsfaty | |
| 2012/0239470 | A1 | | 9/2012 | Goldburt | |
| 2012/0273372 | A1 | | 11/2012 | Goldburt et al. | |
| 2013/0319892 | A1 | | 12/2013 | Goldburt | |
| 2014/0094126 | A1 | | 4/2014 | Sandy | |

OTHER PUBLICATIONS

International Search Report from PCT/US2009/006751, mailed Aug. 17, 2010.

Written Opinion from PCT/US2009/006751, mailed Aug. 17, 2010.

International Preliminary Report on Patentability from PCT/US2009/006751, mailed Nov. 29, 2011.

* cited by examiner

BOTTLE FOR ALCOHOLIC OR NON ALCOHOLIC BEVERAGES

BACKGROUND OF THE INVENTION

The present invention relates to a bottle for alcoholic or non alcoholic beverages.

The term "bottle" in this application is used to identify generally a container which can accommodate an alcoholic beverage or a non alcoholic beverage. Bottles of the above mentioned general type are well known in the art and used everywhere. It is believed that the existing bottles can be further improved.

SUMMARY OF THE INVENTION

Accordingly, it is an object of the present invention to provide a bottle for alcoholic and non alcoholic beverages which constitutes a further improvement of the existing bottles.

In keeping with these objects and with others which will become apparent hereinafter, one feature of the present invention resides, briefly stated, in a bottle for alcoholic or non alcoholic beverages, comprising a hollow body part defining an inner space for filling an alcoholic or non alcoholic beverage; and at least one device selected from the group consisting of an electrical device and an electronic device and integrated in said hollow body part without interfering with the content of the bottle.

In accordance with one embodiment of the present invention, the electrical or electronic device can be a power source, it can be a device operating on electrical or electronic principle, or it can include both a power source and a device operating on electrical or electronic principle.

In accordance with another embodiment of the present invention, the electrical or electronic device can be located in one of the walls of the hollow body of the bottle, for example in a peripheral wall or in a bottom wall.

In accordance with another embodiment of the present invention, the hollow body can be provided with a recess or a receptacle, and the electrical or electronic device can be arranged in the recess. The recess can be formed in one of the walls of the hollow body, for example in the peripheral wall or in the bottom wall.

On the other hand, the electrical device can be located in an area surrounding a portion of the hollow body, for example surrounding a neck of the bottle, etc.

The electrical device can be operative for producing visual messages, audio messages, light, and combinations thereof.

The novel features of which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
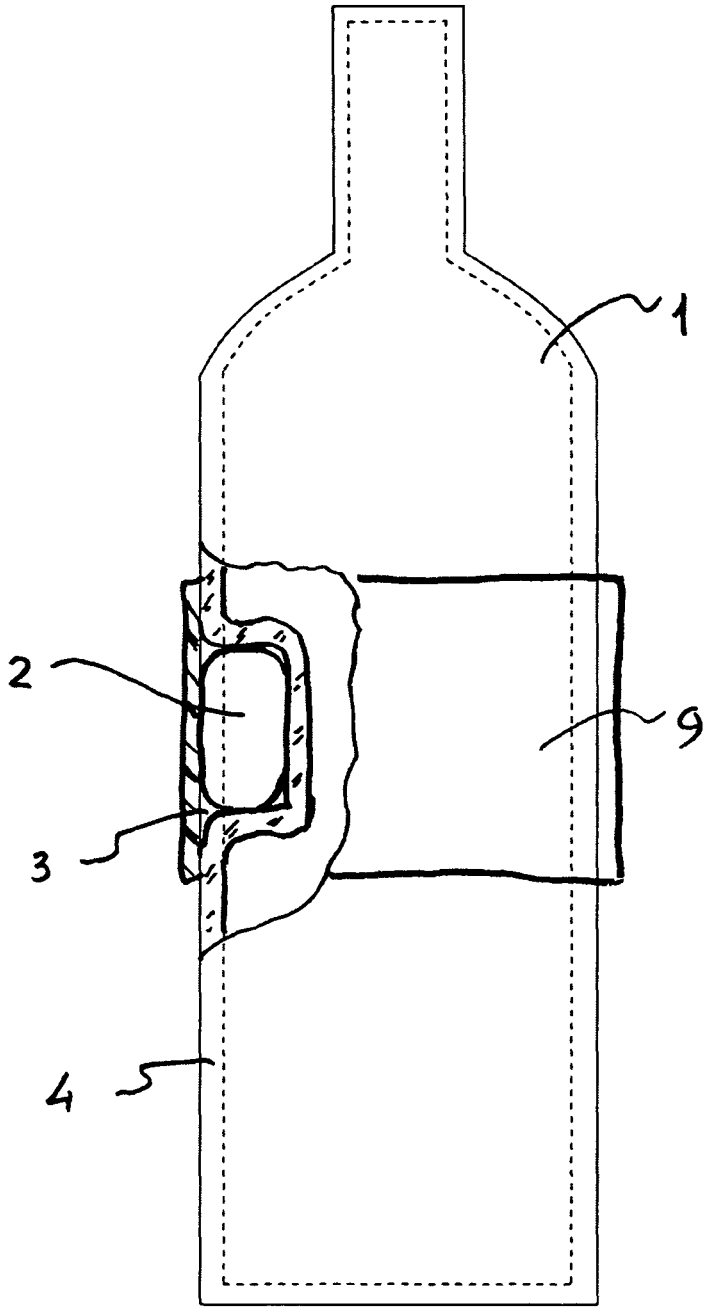
FIG. 1 is a view showing a bottle for alcoholic or non alcoholic beverages in accordance with one embodiment of the present invention.

A bottle in accordance with the present invention has a hollow body which is identified with reference numeral 1 and defines an inner space for accommodating an alcoholic beverage or a non alcoholic beverage. In accordance with the present invention a device selected from the group consisting of an electrical device and an electronic device identified with reference numeral 2 is integrated with the bottle of the invention.

The electrical device or electronic device in the bottle in accordance with the present invention can provide visual messages which can be prerecorded messages or life messages. For example, the device can be a TV display, a PDA display, a PC display, a clock, a decorative display, a running line display, an advertising display, etc. Once activated it produces corresponding visual messages.

The device in accordance with the present invention can be formed so that it produces prerecorded or live audio messages. The device for generating audio messages can be a device for broadcasting radio messages, satellite radio messages, I-pod messages, etc.

The device in accordance with the present invention can be also configured as a device which produces prerecorded or live decorative messages, for example running light, blinking lights, shimmering lights, interference and optical diffraction light effects, light effects based on interaction of light with photonic materials and structures on micro and nano scale, etc.

It is to be understood that it is within the spirit of the invention to provide such a device which combines the visual messages, the audio messages, the light messages, etc., and even other messages not specifically mentioned.

The electrical or electronic device in accordance with the present invention can be provided with wireless connections. The light messages can be produced for example by providing luminescent paints on the bottle with a light emitting device which excites the luminescent paint and makes it glow.

Figure 3:
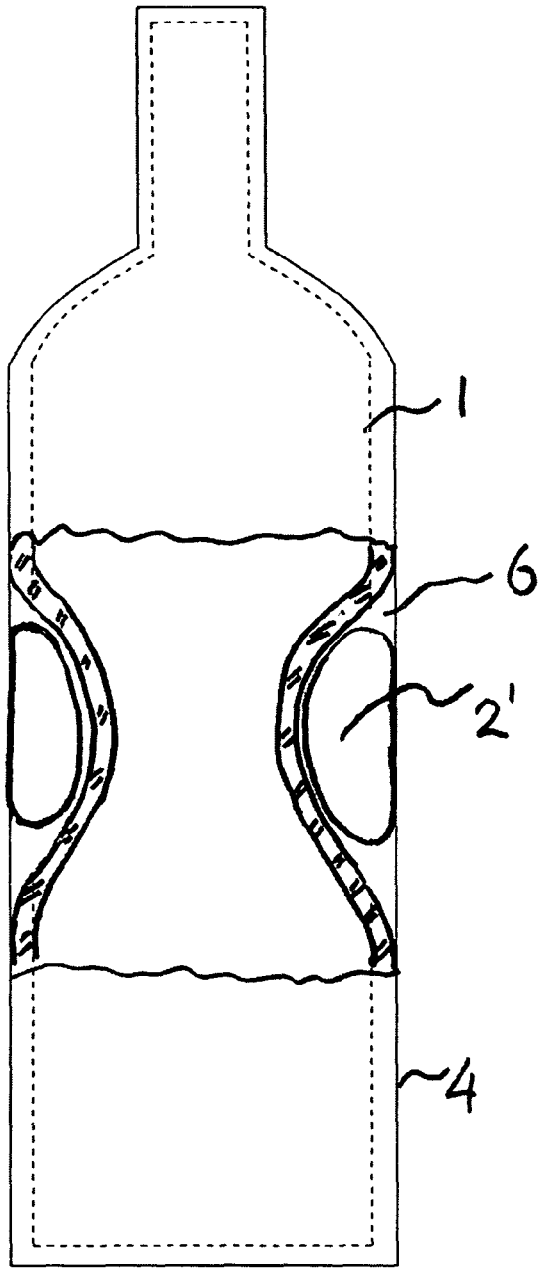
FIG. 3 is a view showing a bottle for alcoholic or non alcoholic beverages in accordance with a further embodiment of the present invention.

In accordance with another embodiment of the present invention the electrical or electronic device can be formed as a power source 2' as shown in FIG. 3. The power source can be formed for example by solar cells, batteries, rechargeable batteries, or combinations thereof.

In accordance with the present invention the electrical or electronic device can be formed as a power source 2' configured for supplying power to an exterior device for any purpose, which is not associated with the bottle, for example to charge a cell phone located outside of the bottle, to power a light source located outside of the bottle, etc.

Figure 2:
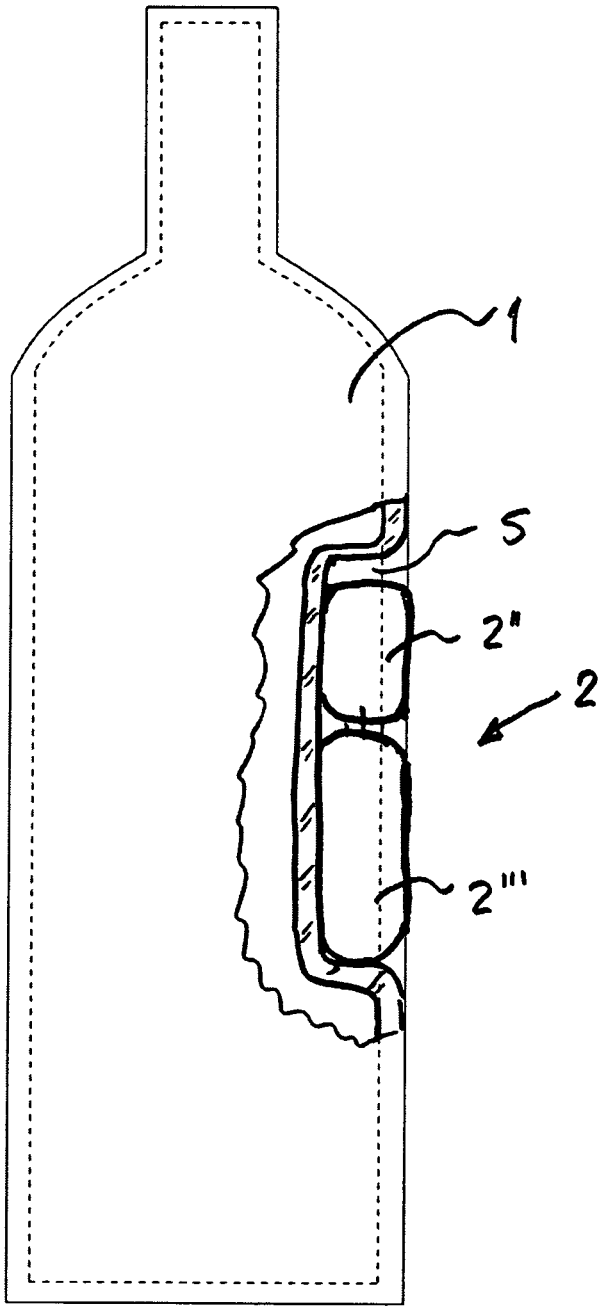
FIG. 2 is a view showing a bottle for alcoholic or non alcoholic beverages in accordance with another embodiment of the present invention.

In accordance with still another embodiment of the present invention, the device can include an electrical or an electronic device 2" and also a power source 2'" provided for supplying power to it for example a TV display powered by solar cells, etc, both integrated in the bottle as shown in FIG. 2.

In accordance with one embodiment of the present invention shown in FIG. 1, the bottle 1 can be provided with a recess 3 which is formed in a peripheral wall 4 of the bottle. The electrical or electronic device 2 of the present invention is accommodated in the recess.

In accordance with a further embodiment shown in FIG. 2, the bottle 1 is provided with an elongated channel 5 formed in the peripheral wall 4. The electrical or electronic device 2 of the present invention is accommodated in the channel.

In accordance with a still further embodiment shown in FIG. 3, the bottle 1 is provided with an annular neck-shaped narrowing groove 6 located between the neck and the bottom of the bottle 1. The electrical or electronic device 2' is accommodated in the annular groove. The electrical or electronic device 2' can be formed as a ring-shaped device which surrounds the neck-shaped portion of the bottle and can have an outer diameter corresponding to the outer diameter of the bottle.

Figure 4:
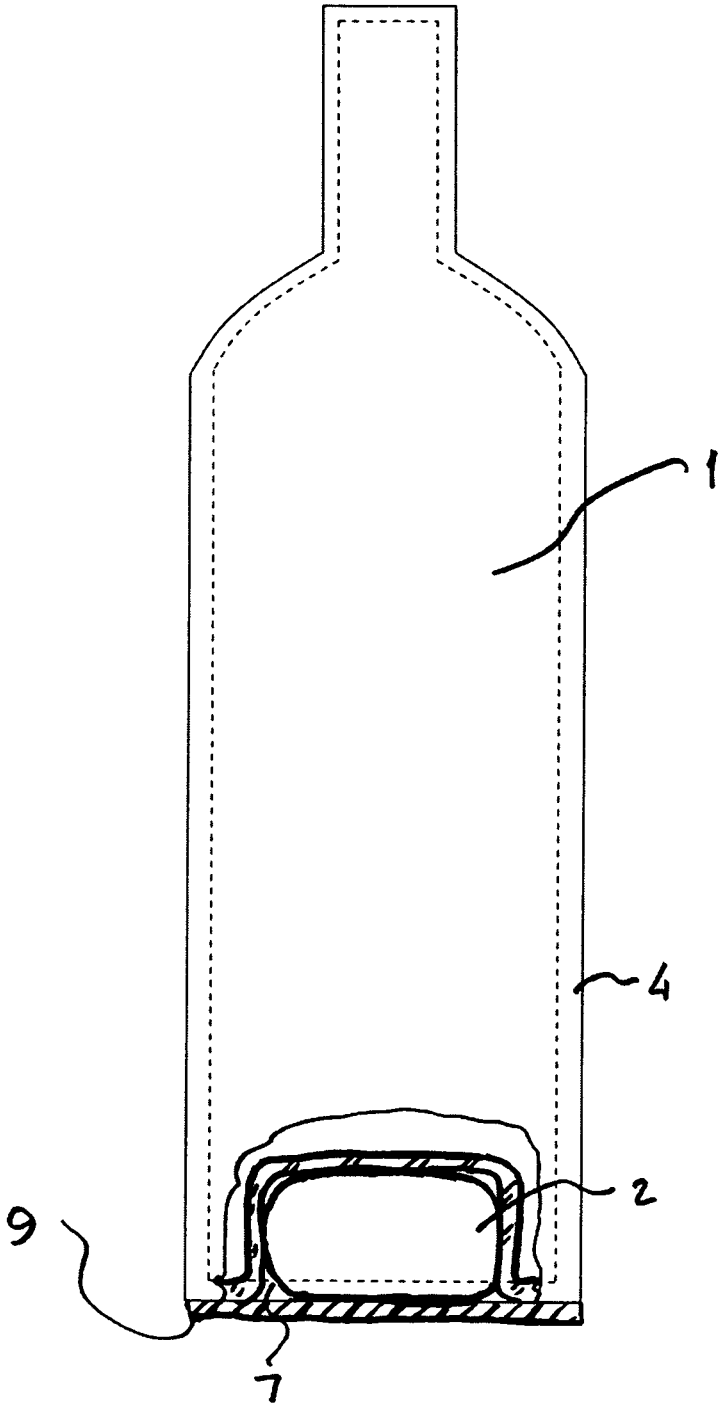
FIG. 4 is a view showing a bottle for alcoholic or non alcoholic beverages in accordance with still a further embodiment of the present invention.

In a still further embodiment of the present invention shown in FIG. 4, a recess 7 is provided in the bottom of the bottle. The electrical or electronic device 2 is accommodated in the bottom-located recess 7.

Figure 5:
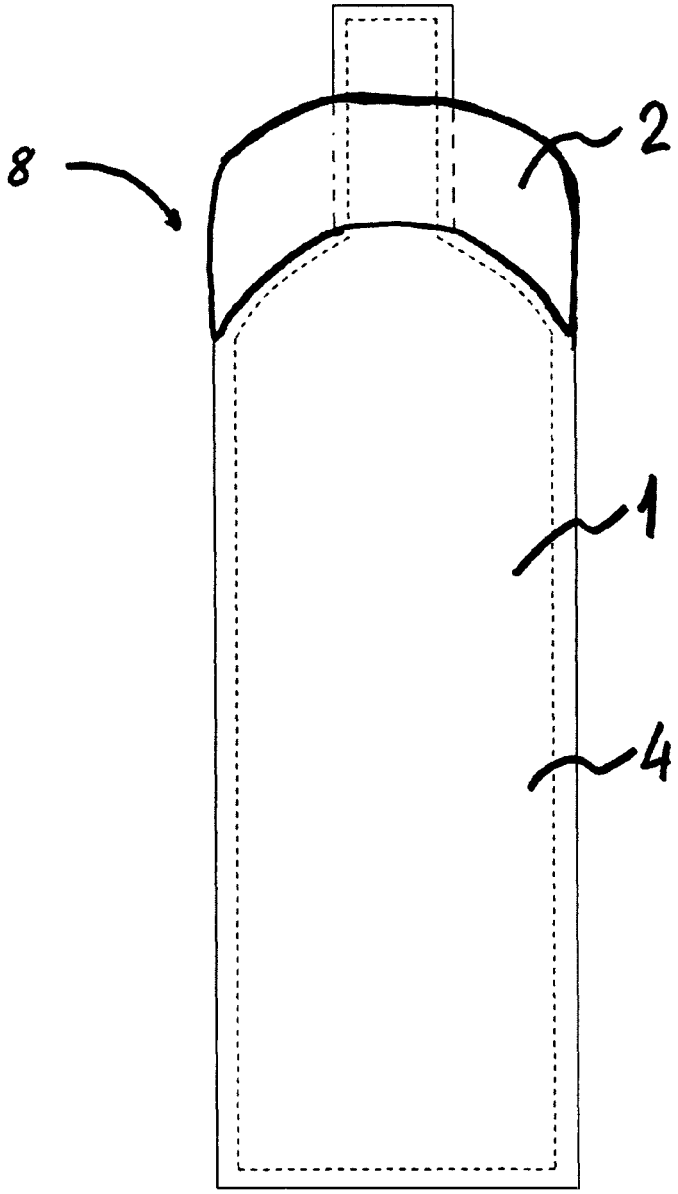
FIG. 5 is a view showing a bottle for alcoholic or non alcoholic beverages in accordance with an additional embodiment of the present invention.

In accordance with a still further feature of the present invention, the electrical or electronic device 2 is located outside the body of the bottle, such as for example in the area 8 around the neck of the bottle 1 as shown in FIG. 5. The device 2 can be formed ring shaped.

Means for covering the electrical or electronic device of the present invention are further provided. They are used so as not to disrupt an outside appearance of the bottle. The means for covering can be formed as a plastic cover 9. The plastic cover can be formed for example as a sleeve which is fittable over the body of the bottle in such a way as to cover the electrical or electronic device integrated in the bottle. The covering means can be also formed as a plastic enclosure which is connected with the body of the bottle, for example by adhesive and the like.

Generally, the electronic or electrical device 2 is integrated in the bottle so that it does not interfere with the content of the bottle and substantially does not extend outwardly beyond its shape.

When the bottle is designed in accordance with the present invention, then in addition to its primary function to accommodate an alcoholic beverage or a non alcoholic beverage, it obtains completely new functionality, namely by acting as a system including a container for a beverage and an electronic or electrical device which provides corresponding additional functions, in addition to dispensing of an alcoholic beverage or a non alcoholic beverage.

The electrical or electronic device integrated in the bottle in accordance with the present invention can operate in the bottle, it can be removed from the bottle and operate separately, it can operate in wireless or in wired fashion, it can cooperate with an exterior device, etc.

The cover which covers the electrical or electronic device in or on the bottle can be formed as a transparent cover or a non-transparent cover. The hollow body can be also composed of a transparent material or a non-transparent material.

Figure 6:
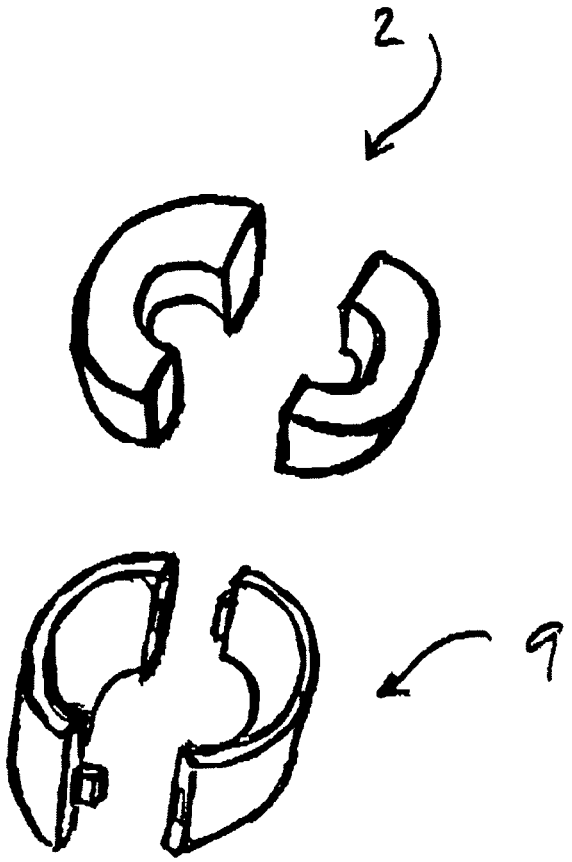
FIG. 6 is a view showing embodiments of a ring shaped device.

FIG. 6 shows that the device 2 can be configured as a ring-shaped device composed of a plurality (at least two) segments. The cover 9 can be configured as a shell which embraces the device and is composed of shell portions, which can be connected with one another by inter-engaging projections and grooves, for example with snap action. This construction can be used with the embodiments shown in other figures.

It will be understood that each of the elements described above, or two or more together, may also find a useful application in other types of constructions differing from the type described above.

While the invention has been illustrated and described as embodied in a bottle for alcoholic or non alcoholic beverages, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

The invention claimed is:

1. A bottle for alcoholic or non-alcoholic beverages in combination with an electrical or electronic device, comprising:

the bottle having a hollow body with a cylindrical outer surface about a central longitudinal axis and defining an inner space for accommodating a beverage, wherein at least one portion of said cylindrical outer surface of said hollow body includes a cavity which is arcuate about said central longitudinal axis, and wherein said arcuate cavity is open outwardly, is limited inwardly by a cylindrical inner wall, and at least partially circumscribes said cylindrical inner wall; and the electrical or electronic device integrated in said hollow body without interfering with content of the bottle, wherein said electrical or electronic device is configured so that it is accommodated in said arcuate outwardly open cavity, and has a curvilinear rear surface generally conforming to said cylindrical inner wall of said cavity and a front surface that does not extend substantially outwardly from said cylindrical outer surface of said hollow body of said bottle, wherein said electrical or electronic device is a device configured to produce a visual message selected from the group consisting of a TV display, a PDA display, a PC display, a running line display, and an advertising display, and wherein said electrical or electronic device has a shape of at least a part of an annular ring with a circumferential outer surface which forms said front surface and on which said visual message is to be displayed.

2. A bottle for alcoholic or non-alcoholic beverages in combination with an electrical or electronic device, as defined in claim 1, wherein said front surface of said electrical or electronic device is curvilinear and has a radius substantially similar to a radius of said cylindrical outer surface of said hollow body of said bottle.

3. A bottle for alcoholic or non-alcoholic beverages in combination with an electrical or electronic device as defined in claim 1, wherein said bottle has a neck at a top and an opposite bottom, and wherein said arcuate outwardly open cavity is situated axially between said neck and said bottom.

4. A bottle for alcoholic or non-alcoholic beverages in combination with an electrical or electronic device as defined in claim 1, wherein said visual message displayable by said electrical or electronic device is prerecorded, and said electrical or electronic device is activatable to display said visual message by a user.

5. A bottle for alcoholic or non-alcoholic beverages in combination with an electrical or electronic device as defined in claim 1, wherein said electrical or electronic device is activatable by a user.

6. A bottle for alcoholic or non-alcoholic beverages in combination with an electrical or electronic device, comprising:

the bottle having a hollow body with a cylindrical outer surface about a central longitudinal axis and defining an inner space for accommodating a beverage, wherein at least one portion of said cylindrical outer surface of said hollow body includes a cavity which is arcuate about said central longitudinal axis, and wherein said arcuate cavity is open outwardly, is limited inwardly by a cylindrical inner wall, and at least partially circumscribes said cylindrical inner wall; and the electrical or electronic device integrated in said hollow body without interfering with content of the bottle, wherein said electrical or electronic device is configured so that it is accommodated in said arcuate outwardly open cavity, and has a curvilinear rear surface generally conforming to said cylindrical inner wall of said cavity and a front surface that does not extend substantially outwardly from said cylindrical outer surface of said hollow body of said bottle, wherein said electrical or electronic device has a shape of an annular sleeve accommodated in said arcuate outwardly open cavity, and wherein said electrical or electronic device is a device configured to produce a visual message selected from the group consisting of a TV display, a PDA display, a PC display, a running line display, and an advertising display.

7. A bottle for alcoholic or non-alcoholic beverages in combination with an electrical or electronic device, comprising the bottle having a hollow body with a cylindrical outer surface about a central longitudinal axis and defining an inner space for accommodating a beverage, wherein at least one portion of said cylindrical outer surface of said hollow body includes a cavity which is arcuate about said central longitudinal axis, and wherein said cavity is open outwardly, is limited inwardly by a cylindrical inner wall, and at least partially circumscribes said cylindrical inner wall; and the electrical or electronic device integrated in said hollow body without interfering with content of the bottle, wherein said electrical or electronic device is configured so that it is accommodated in said arcuate outwardly open cavity, and has a curvilinear rear surface generally conforming to said cylindrical inner wall of said cavity and a front surface that does not extend substantially outwardly from said cylindrical outer surface of said hollow body of said bottle, wherein said electrical or electronic device has a shape of an annular sleeve accommodated in said arcuate outwardly open cavity, and wherein said electrical or electronic device is a device configured to provide visual messages selected from the group consisting of decorative messages, running light, blinking lights, shimmering lights, interference light effects, optical diffraction light effects, light effects based on interaction of light with photonic materials, and structures of micro and nano scale.

8. A bottle for alcoholic or non-alcoholic beverages in combination with an electrical or electronic device, as defined in claim 7, wherein said front surface of said electrical or electronic device is curvilinear and has a radius substantially similar to a radius of said cylindrical outer surface of said hollow body of said bottle.

9. A bottle for alcoholic or non-alcoholic beverages in combination with an electrical or electronic device, comprising:

the bottle having a hollow body with a cylindrical outer surface about a central longitudinal axis and defining an inner space for accommodating a beverage, wherein at least one portion of said cylindrical outer surface of said hollow body includes a cavity which is about said central longitudinal axis, and wherein said cavity is open outwardly, is limited inwardly by a cylindrical inner wall, and at least partially circumscribes said cylindrical inner wall; and the electrical or electronic device integrated in said hollow body without interfering with content of the bottle, wherein said electrical or electronic device is configured so that it is accommodated in said arcuate outwardly open cavity, and has a curvilinear rear surface generally conforming to said cylindrical inner wall of said cavity and a front surface that does not extend substantially outwardly from said cylindrical outer surface of said hollow body of said bottle, wherein said electrical or electronic device is a device configured to provide visual messages selected from the group consisting of decorative messages, running light, blinking lights, shimmering lights, interference light effects, optical diffraction light effects, light effects based on interaction of light with photonic materials, and structures of micro and nano scale, and wherein said electrical or electronic device has a shape of at least a part of an annular ring with a circumferential outer surface which forms said front surface and on which said visual messages are to be displayed.

10. A bottle for alcoholic or non-alcoholic beverages in combination with an electrical or electronic device as defined in claim 7, wherein said bottle has a neck at a top and an opposite bottom, and wherein said arcuate outwardly open cavity is situated axially between said neck and said bottom.

11. A bottle for alcoholic or non-alcoholic beverages in combination with an electrical or electronic device as defined in claim 7, wherein said visual message displayable by said electrical or electronic device is prerecorded, and said electrical or electronic device is activatable to display said visual message by a user.

12. A bottle for alcoholic or non-alcoholic beverages in combination with an electrical or electronic device as defined in claim 7, wherein said electrical or electronic device is activatable by a user.

* * * * *